US011844386B2

(12) United States Patent
Armendariz

(10) Patent No.: US 11,844,386 B2
(45) **Date of Patent: *Dec. 19, 2023**

(54) HAT WITH EXENDABLE VISOR

(71) Applicant: Steven Luis Armendariz, Laguna Beach, CA (US)

(72) Inventor: Steven Luis Armendariz, Laguna Beach, CA (US)

( * ) Notice: Subject to any disclaimer, the term of this patent is extended or adjusted under 35 U.S.C. 154(b) by 24 days.

This patent is subject to a terminal disclaimer.

(21) Appl. No.: 17/079,456

(22) Filed: Oct. 24, 2020

(65) Prior Publication Data

US 2021/0037903 A1 Feb. 11, 2021

Related U.S. Application Data

(63) Continuation of application No. 15/953,307, filed on Apr. 13, 2018, now Pat. No. 10,820,651.

(Continued)

(51) Int. Cl.

| | |
|---|---|
| ***A42B 1/0185*** | (2021.01) |
| ***A42B 1/006*** | (2021.01) |
| ***A42B 1/22*** | (2006.01) |
| ***A42B 1/0182*** | (2021.01) |
| ***A42B 1/06*** | (2021.01) |

(52) U.S. Cl.

CPC ..... *A42B 1/006* (2013.01); *A42B 1/0182* (2021.01); *A42B 1/0185* (2021.01); *A42B 1/06* (2013.01); *A42B 1/22* (2013.01)

(58) Field of Classification Search

CPC ... A42B 1/0183; A42B 1/0184; A42B 1/0185; A42B 1/062; A42B 1/064; A42B 1/065; A42B 1/22; A42B 1/205; A42B 1/247; A42B 3/00; A42B 3/006; A42B 3/166; A42B 3/20; A42B 3/221; A42B 3/226; A42B 5/00; A42B 7/00; A42B 1/06;

(Continued)

(56) References Cited

U.S. PATENT DOCUMENTS 716,258 A * 12/1902 Maass ..... A42B 1/247 2/10
1,610,745 A * 12/1926 Castanaro ..... A42B 1/0182 2/10

(Continued)

FOREIGN PATENT DOCUMENTS

JP 2006097164 4/2006
JP 2006097164 A * 4/2006

*Primary Examiner* — Megan E Lynch
*Assistant Examiner* — Giao Qt Hoang
(74) *Attorney, Agent, or Firm* — Enterprise Patent LLC

(57) ABSTRACT

A hat with an adjustable visor includes a shell disposed on a user's head, an upper visor coupled to the shell and having a plurality of elongated slots, each elongated slot having a pair of rails extending along opposing side walls of the elongated slot, and a lower visor slidably mounted to the upper visor and having a plurality of tab assemblies, each tab assembly slidably mounted to the pair of rails of one of the plurality of elongated slots in the upper visor. The lower visor slidably adjusts relative to the shell to enable the plurality of tab assemblies of the lower visor to traverse the pairs of rails in the plurality of elongated slots of the upper visor, thereby extending the lower visor beyond the upper visor in an extended position or retracting the lower visor to align with the upper visor in a retracted position.

24 Claims, 4 Drawing Sheets

Related U.S. Application Data

(60) Provisional application No. 62/459,386, filed on Feb. 15, 2017.

(58) Field of Classification Search
CPC ..... A42B 1/0182; A41D 13/00; A41D 13/11; A41D 15/00; A41D 17/00; A41D 27/00
USPC ..... 2/10, 424, 195
See application file for complete search history.

(56) References Cited

U.S. PATENT DOCUMENTS 1,807,180 A 5/1931 Solomon
3,315,272 A * 4/1967 Olt ..... A42B 3/226 2/424
4,887,320 A * 12/1989 Long ..... A42B 3/226 2/424
5,075,898 A * 12/1991 Bedient ..... A42B 1/0185 2/10
5,197,150 A * 3/1993 Bedient ..... A42B 1/0185 2/10
5,621,915 A * 4/1997 Schneider ..... A42B 1/0185 2/10
5,689,830 A * 11/1997 Pflum ..... A42B 1/0185 2/10
5,715,534 A * 2/1998 Mobley ..... A42B 1/0184 2/10
5,839,125 A * 11/1998 Chen ..... A42B 1/0185 2/10
6,044,495 A 4/2000 Ellman et al.
6,202,218 B1 3/2001 Chen
D499,231 S * 12/2004 Toppel ..... D2/882
6,959,454 B2 11/2005 DeWinter
9,433,253 B2 * 9/2016 McKinney ..... A42B 3/227
10,820,651 B1 * 11/2020 Armendariz ..... A42B 1/006
2009/0064397 A1 * 3/2009 Chuang ..... A42B 3/226 2/424
2012/0260399 A1 * 10/2012 Verbout ..... A42B 1/0185 2/209.12
2019/0037950 A1 * 2/2019 Prezioso ..... A42B 1/0184

* cited by examiner

HAT WITH EXENDABLE VISOR

RELATED APPLICATIONS

This application claims priority from U.S. patent application Ser. No. 15/953,307 filed on Apr. 13, 2018 (now U.S. Pat. No. 10,820,651, issued on Nov. 3, 2020), which claims priory from U.S. provisional patent application No. 62/459,386 filed on Feb. 15, 2017, the entire contents of both of these applications are herein incorporated by reference.

BACKGROUND

The embodiments herein relate generally to hats. More specifically, embodiments of the invention are directed to a hat with an extendable visor.

Individuals wear hats to keep their heads warm and protect themselves from environmental elements such as the sun, wind and precipitation. Hats also are worn as a stylish accessory with many varieties for different occasions. Common styles of hats include the baseball hat and trucker hat, which are popular for use when exercising, engaging in athletic events or other casual activities. These hats comprise a plurality of panels coupled together to form a hemispherical shell that conforms around the user's head, and a visor coupled to the shell extending away from the user's face.

One common issue with baseball and trucker hats is that when worn at certain positions, the sun may shine directly on the face and into the wearer's eyes, thereby blinding the wearer by the direct sun rays. In many situations, the wearer can turn his/her head away from the sun. However, in certain situations, the wearer is required to face the sun directly when focusing on a particular location, such as when preparing to make a golf shot on an outdoor course. Therefore, there is a need for hats with extendable visors to adjust to provide greater protection to the wearer's face and eyes.

U.S. Pat. D499,231, U.S. Pat. Nos. 5,197,150 and 5,075,898 disclose a variety of hats with extendable or retractable visors. However, these hats are limited because they lack strength and stability in their visor adjustment mechanism. In particular, these hats use fasteners such as rivets and press fit pins as part of their adjustable tracks to extend or retract the visor on the hat. However, these components of the adjustment mechanisms are flimsy, prone to wear, and/or do not result in a durable visor that can be adjusted smoothly and easily throughout the entirety of the hat's lifespan.

As such, there is a need in the industry for a hat with an extendable visor with enhanced strength, stability and durability that addresses the limitations of the prior art. There is a need for the hat to have an adjustable visor that can be maneuvered smoothly and easily for the entire lifespan of the hat.

SUMMARY

A hat worn on a head of a user with an adjustable visor is provided. The adjustable visor of the hat is configured to extend and retract with enhanced fluidity and stability during adjustments. The hat comprises a shell configured to be disposed on the head of the user, an upper visor coupled to the shell and comprising a plurality of elongated slots, each elongated slot in the plurality of elongated slots comprising a pair of rails continuously connected to the upper visor and extending along opposing side walls of the elongated slot, and a lower visor slidably mounted to the upper visor and comprising a plurality of tab assemblies, each tab assembly in the plurality of tab assemblies slidably mounted to the pair of rails of one of the plurality of elongated slots in the upper visor, wherein the lower visor is configured to slidably adjust in a first direction relative to the shell to enable the plurality of tab assemblies of the lower visor to traverse the pairs of rails in the plurality of elongated slots of the upper visor, thereby extending the lower visor beyond the upper visor in an extended position; wherein the lower visor is configured to slidably adjust in a second direction relative to the shell to enable the plurality of tab assemblies of the lower visor to traverse the pairs of rails in the plurality of elongated slots of the upper visor, thereby retracting the lower visor to align with the upper visor in a retracted position.

BRIEF DESCRIPTION OF THE FIGURES

The detailed description of some embodiments of the invention will be made below with reference to the accompanying figures, wherein the figures disclose one or more embodiments of the present invention.

DETAILED DESCRIPTION OF CERTAIN EMBODIMENTS

Figure 1:
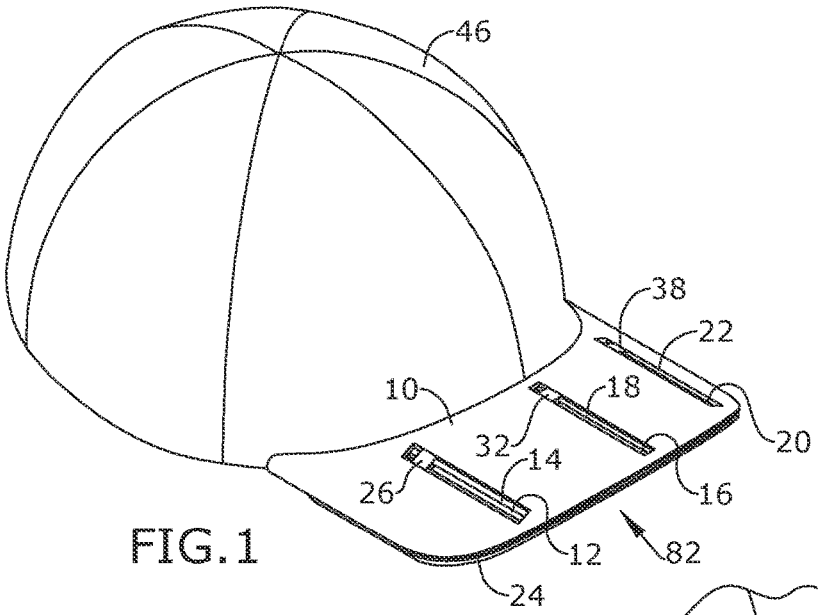
FIG. 1 depicts a top perspective view of certain embodiments of the hat in a retracted position.
Figure 2:
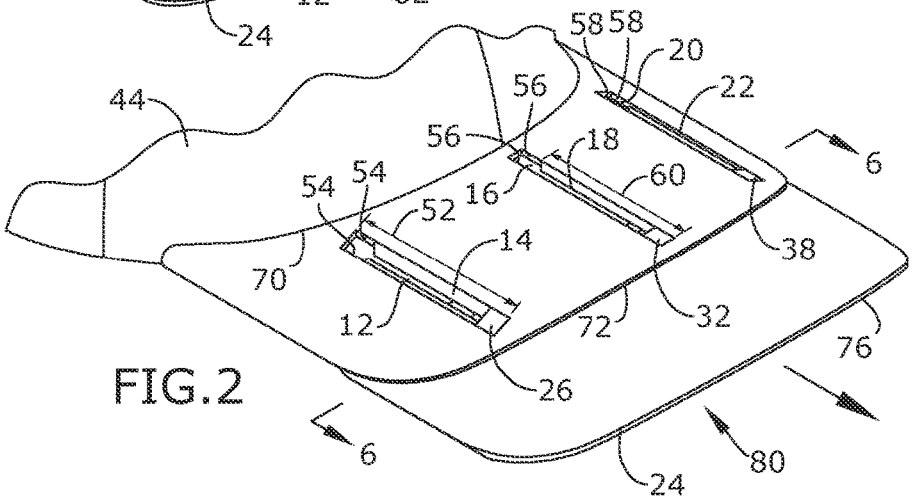
FIG. 2 depicts a top perspective view of certain embodiments of the hat in an extended position.
Figure 3:
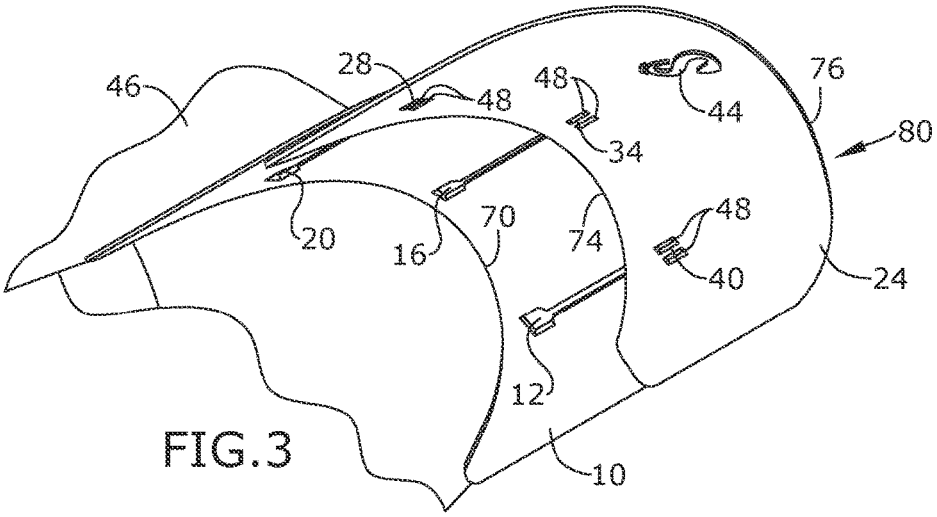
FIG. 3 depicts a bottom perspective view of certain embodiments of the hat in the extended position.

As depicted in FIGS. 1-3 and 5, hat 46 comprises a plurality of panels coupled together to form a generally hemispherical shell designed to fit around the head of a user and an adjustable visor comprising upper visor 10 slidably mounted to lower visor 24. Lower visor 24 is configured to slidably adjust relative to upper visor 10 to an extended position as depicted in FIGS. 2-3 or a retracted position as depicted in FIG. 1.

In a preferred embodiment, upper and lower visors 10, 24 are attached to the edge of hat 46, which is a baseball or trucker style hat. However, upper and lower visors 10, 24 may be used with alternative types of hats including, but not limited to, military hats, visor hats, newsboy caps, and the like. The shell of hat 46 may be made from any materials known in the field including, but not limited to, cotton, wool, polyester, Spandex or other materials.

Upper visor 10 is coupled to the shell of hat 46. In one embodiment, a portion of the panels of hat 46 is sewn to a connecting material by stitching. The connecting material will partially encapsulate and be stitched to upper visor 10. The connecting material may be any material including, but not limited to, cotton, wool, other fabric, and the like. Lower visor 24 is slidably mounted to upper visor 10. In a preferred embodiment, each visor member in upper and lower visors 10, 24 is made from a single and continuous member made from any material including, but not limited to, a plastic such as polyphenylene ether (PPE), other type of plastic, polymer, rubber, fabric, Kevlar or other synthetic material.

As depicted in FIGS. 1-5, upper visor 10 comprises an upper visor proximal edge 70, an upper visor distal edge 72, and a plurality of slots formed through the upper visor. In a preferred embodiment, first slot 12, second slot 16 and third slot 20 are disposed through upper visor 10. However, an alternative number of slots may be present in upper visor 10 in an alternative embodiment. Each slot in first, second and third slots 12, 16, 20 comprises an elongated generally rectangular-shaped slot, having a slot length 52. A first pair of rails 14 is coupled to first slot 12 and extends along opposing side walls 54 of first slot 12. A second pair of rails 18 is coupled to second slot 16 and extends along opposing side walls 56 of second slot 16. A third pair of rails 22 is coupled to third slot 20 and extends along opposing side 58 walls of third slot 20. The rails have a rail length 60.

Figure 4:
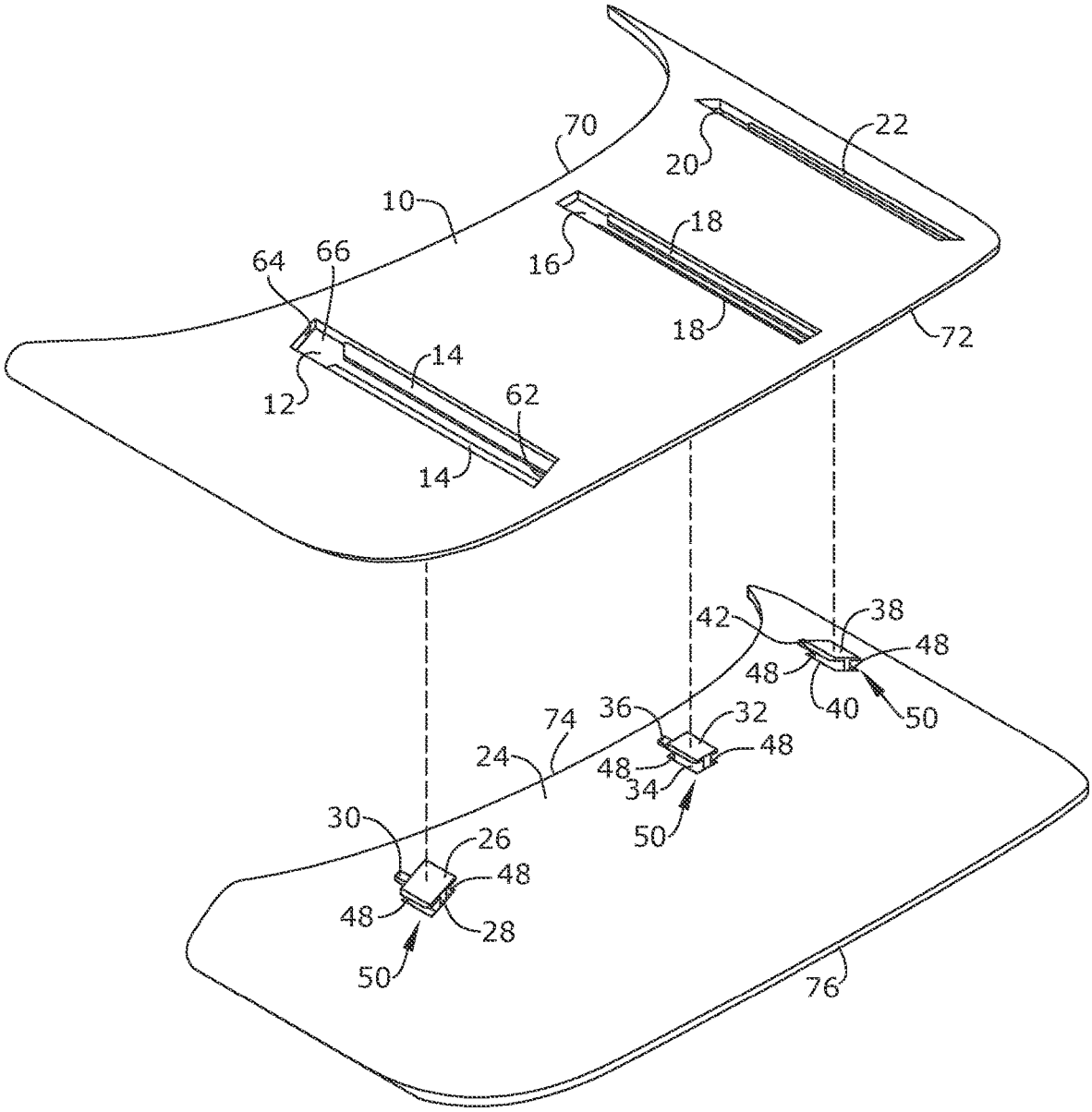
FIG. 4 depicts an exploded view of certain embodiments of the hat.
Figure 5:
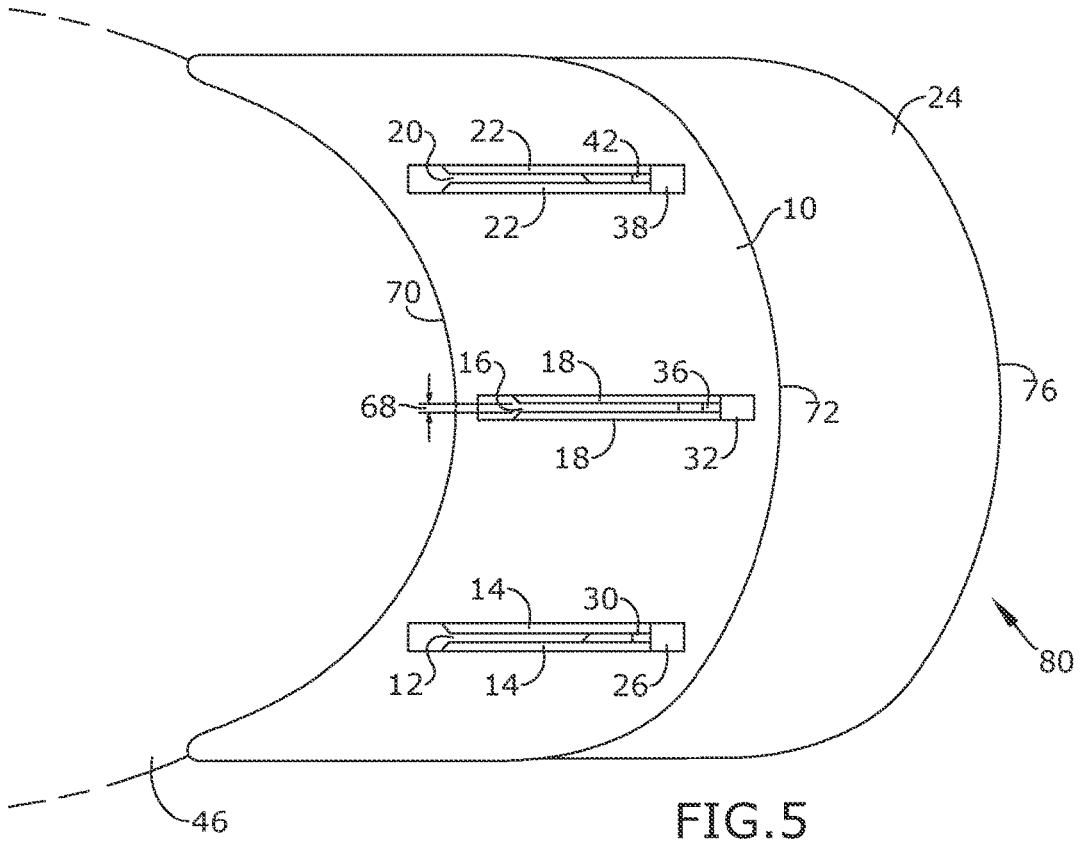
FIG. 5 depicts a top view of certain embodiments of the hat in the extended position.

In a preferred embodiment, first, second and third pairs of rails 14, 18, 22 extend from a first end face 62 of the slot to a location proximate the other opposing end face 64 of the slot. As depicted in FIG. 4, this creates a wider opening 66 present at one end of each slot 12, 16, 20 in space where the corresponding pair of rails 14, 18, 22 is not present.

As depicted in FIGS. 3-4, lower visor 24 comprises a lower visor proximal edge 74, a lower visor distal edge 76, and a plurality of tab assemblies 50 configured to engage with the pairs of rails 14, 18, 22 in first, second and third slots 12, 16, 20. As such, the pairs of rails 14, 18, 22, each pair respectively spaced apart by the distance 68, serve as tracks for tab assemblies 50 to slide on. These rails and tab assemblies serve as the mechanism that permits lower visor 24 to slidably adjust relative to upper visor 10.

In a preferred embodiment, hat 46 comprises three tab assemblies 50 that correspond to first, second and third slots 12, 16, 20. However, the number of tab assemblies 50 present on lower visor 24 may vary to match the number of slots present in upper slot 10. The first tab assembly 50 comprises first upper plate 26, first lower post 28 and first stop protrusion 30. Similarly, the second tab assembly 50 comprises second upper plate 32, second lower post 34 and second stop protrusion 36. The third tab assembly 50 comprises third upper plate 38, third lower post 40 and third stop protrusion 42.

First, second and third tab assemblies 50 are identical to each other. For simplicity, focus will be directed to the first tab assembly 50 for illustrative purposes. First upper plate 26 and first lower post 28 form a generally T-shaped member. The opposing ends of first lower post 28 connect to lower visor 24 as depicted in FIG. 3. A pair of slits 48 are disposed through lower visor 24 and extend along opposite sides of first lower post 28. First stop protrusion 30 is coupled to first lower post 28 and is configured to extend toward the shell of hat 46. Second and third tab assemblies 50 comprise the same components as first tab assembly 50 and are connected to lower visor 24 in the same manner.

In one embodiment, grip member 44 is coupled to the bottom face of lower visor 24. In one embodiment, grip member 44 is positioned in the center of the bottom face of lower visor 24. Grip member 44 serves as a finger placement location for a user to grab when making sliding adjustments of lower visor 24 relative to upper visor 10. Grip member 44 may have variable shapes, designs, logos, and the like. In a preferred embodiment, grip member 44 is made from the same material as lower visor 24.

Figure 6:
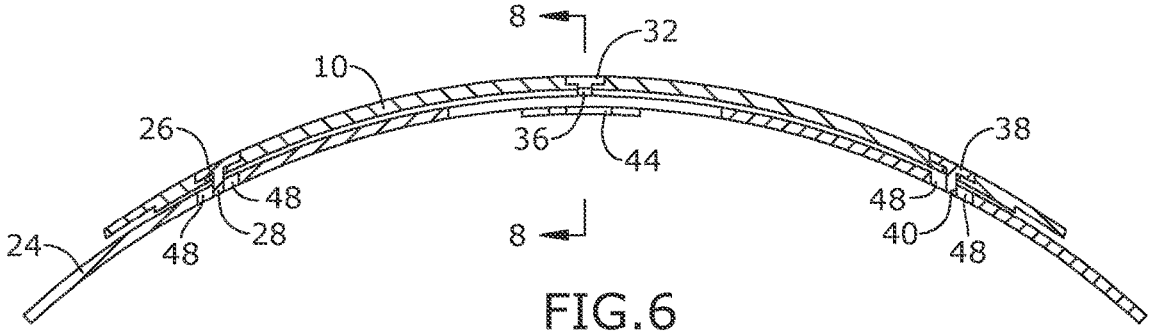
FIG. 6 depicts a section view of certain embodiments of the hat taken along line 6-6 in FIG. 2.
Figure 7:
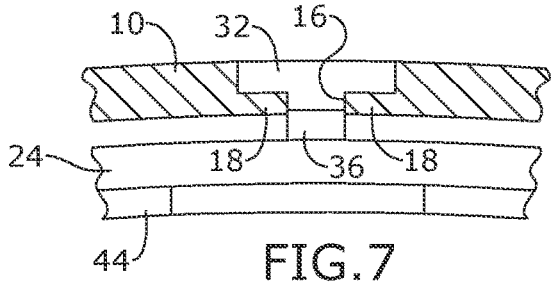
FIG. 7 depicts a section view of certain embodiments of the hat.
Figure 8:
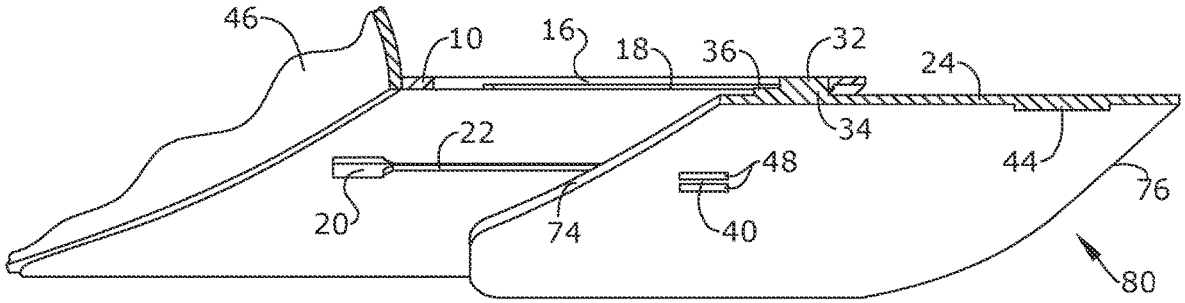
FIG. 8 depicts a section view of certain embodiments of the hat taken along line 8-8 in FIG. 6.

To assemble hat 46, lower visor 24 is connected to upper visor 10. Specifically, tab assemblies 50 of lower visor 24 are press-fitted and snapped through the wide end openings in first, second and third slots 12, 16, 20 where first pair of rails 14, second pair of rails 18 and third pair of rails 22 are not present. Once lower visor 24 is connected to upper visor 10, the visor of hat 46 is complete. Lower visor 24 can then slidably adjust relative to upper visor 10. FIGS. 6-7 depict the assembled configuration of upper visor 10 and lower visor 24 connected together.

Figure 9:
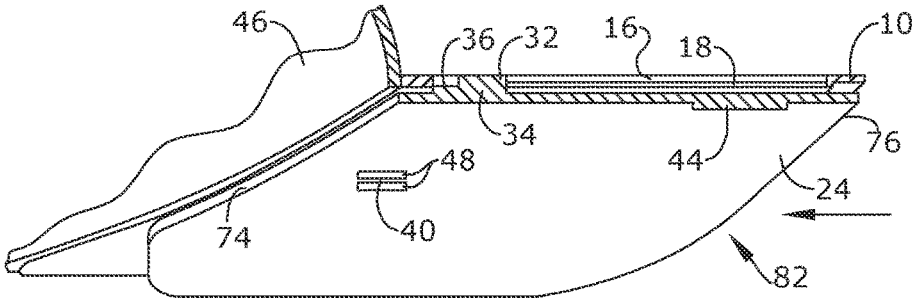
FIG. 9 depicts a section view of certain embodiments of the hat in the retracted position.

In operation of hat 46, a user slidably adjusts lower visor 24 relative to upper visor 10 as desired. The user maneuvers lower visor 24 to slidably adjust in a first direction relative to the shell of hat 46 to enable first, second and third upper plates 26, 32, 38 of tab assemblies 50 to slide along the top of first, second and third rails 14, 18, 22 of upper visor 10 to an extended position 80 as depicted in FIGS. 2-3, 5 and 8. In the extended position 80, lower visor 24 extends beyond upper visor 10. The user maneuvers lower visor 24 to slidably adjust in a second direction relative to the shell of hat 46 to enable first, second and third upper plates 26, 32, 38 of tab assemblies 50 to slide along the top of first, second and third rails 14, 18, 22 of upper visor 10 to a retracted position 82 as depicted in FIGS. 1 and 9. In the retracted position 82, lower visor 24 is aligned with upper visor 10. It shall be appreciated that lower visor 24 can be extended or retracted to varying degrees as desired by the user within the limits of space in first, second and third slots 12, 16, 20.

In the fully retracted position 82, first, second and third stop protrusions 30, 36, 42 of tab assemblies 50 contact the end side wall of first, second and third slots 12, 16, 20 as depicted in FIGS. 1 and 9. In this position 82, first, second and third stop protrusions 30, 36, 42 place tab assemblies 50 partially away from the wide end openings in first, second and third slots 12, 16, 20. This prevents tab assemblies 50 from passing through first, second and third slots 12, 16, 20 and resulting in detachment of lower visor 24 from upper visor 10. Therefore, first, second and third stop protrusions 30, 36, 42 serve as locking mechanisms that ensure lower visor 24 remains connected to upper visor 10.

It shall be appreciated that hat 46 has several advantages. The fastening and adjustment mechanisms of tab assemblies 50 and rails 14, 18, 22 in slots 12, 16, 20 enhance the strength, stability and durability of the hat's adjustable visor. This ensures the smooth and easy operation of the hat's visor during adjustments. The adjustable visor of hat 46 helps the user to better protect his/her face and eyes from the sun or other lighting. Finally, the increased surface area of upper visor 10 and lower visor 24 allows hat 46 to display more promotional material as desired.

It shall be appreciated that the components of hat 46 described in several embodiments herein may comprise any alternative known materials in the field and be of any color, size and/or dimensions. It shall be appreciated that the components of hat 46 described herein may be manufactured and assembled using any known techniques in the field.

Persons of ordinary skill in the art may appreciate that numerous design configurations may be possible to enjoy the functional benefits of the inventive systems. Thus, given the wide variety of configurations and arrangements of embodiments of the present invention, the scope of the invention is reflected by the breadth of the claims below rather than narrowed by the embodiments described above.

What is claimed is:

1. A hat worn on a head of a user with an adjustable visor, the hat comprising:

a shell configured to be disposed on the head of the user, wherein the shell has a front shell surface;

an upper visor comprising a plurality of elongated slots formed through the upper visor, each elongated slot having a first end face, a second end face and a pair of opposing side walls connecting the first and second end faces together, each elongated slot having a slot length extending between the first and second end faces, wherein each elongated slot in the plurality of elongated slots comprises a pair of rails connected to the upper visor, each pair of rails having a distance between them and each pair of rails having a rail length that is shorter than the slot length such that the pair of rails partly extends along the elongated slot to create an opening between the side walls and between the rails and the second end face of the elongated slot proximate the shell such that the opening is wider than the distance between the pair of rails in the elongated slot; and a lower visor mounted in relative slidable engagement with the upper visor and comprising a plurality of tab assemblies, each tab assembly in the plurality of tab assemblies slidably mounted to the pair of rails of one of the plurality of elongated slots in the upper visor;

wherein the upper visor is coupled to the shell and projects from the front shell surface at an angle that is substantially transverse to the front shell surface;

wherein the lower visor is configured to enable relative movement between the plurality of tab assemblies and the pairs of rails in the plurality of elongated slots to slidably adjust in a first direction relative to the shell, thereby extending the lower visor beyond the upper visor in an extended position at the angle that is substantially transverse to the front shell surface; and wherein the lower visor is configured to enable relative movement between the plurality of tab assemblies and the pairs of rails in the plurality of elongated slots to slidably adjust in a second direction relative to the shell, thereby retracting the lower visor to align with the upper visor in a retracted position.

2. The hat of claim 1, wherein each tab assembly in the plurality of tab assemblies comprises a plate disposed on the pair of rails of one of the plurality of elongated slots in the upper visor and a post coupled to the plate and lower visor, the post oriented generally upright and extending through spacing between the pair of rails.

3. The hat of claim 2, wherein each tab assembly in the plurality of tab assemblies comprises a stop protrusion coupled to the post, the stop protrusion configured to contact the second end face of the elongated slot in one of the plurality of elongated slots when the lower visor is in the retracted position.

4. The hat of claim 2, wherein the lower visor comprises a plurality of pairs of slits disposed therethrough, each pair of slits in the plurality of pairs of slits extending along opposite sides of the post of one of the tab assemblies in the plurality of tab assemblies.

5. The hat of claim 1, further comprising a grip member coupled to a bottom surface of the lower visor.

6. The hat of claim 1, wherein each slot has a slot width between opposing side walls of the slot, wherein each pair of rails forms a rail-slot width between the rails along their lengths, wherein the rail-slot width is shorter than the slot width, and wherein the opening is wider than the rail-slot width between the pair of rails.

7. The hat of claim 1, wherein the upper visor has an upper visor upper surface and an upper visor lower surface, and wherein the pair of opposing side walls is situated between the upper visor upper surface and the upper visor lower surface.

8. An adjustable visor apparatus coupled to a hat comprising a shell configured to be disposed around a head of a user, wherein the shell has a front shell surface, the adjustable visor apparatus comprising:

an upper visor comprising a plurality of elongated slots formed through the upper visor, each elongated slot having a first end face, a second end face and a pair of opposing side walls connecting the first and second end faces together, each elongated slot having a slot length extending between the first and second end faces, wherein each elongated slot in the plurality of elongated slots comprises a pair of rails connected to the upper visor, each pair of rails having a distance between them and each pair of rails having a rail length that is shorter than the slot length such that the pair of rails partly extends along the elongated slot to create an opening between the side walls and between the rails and the second end face of the elongated slot proximate the shell such that the opening is wider than the distance between the pair of rails in the elongated slot; and a lower visor mounted in relative slidable engagement with the upper visor and comprising a plurality of tab assemblies, each tab assembly in the plurality of tab assemblies slidably mounted to the pair of rails of one of the plurality of elongated slots in the upper visor;

wherein the upper visor is configured to be coupled to the shell and projects from the front shell surface at an angle that is substantially transverse to the front shell surface;

wherein the lower visor is configured to enable relative movement between the plurality of tab assemblies and the pairs of rails in the plurality of elongated slots to slidably adjust in a first direction relative to the shell, thereby extending the lower visor beyond the upper visor in an extended position at the angle that is substantially transverse to the front shell surface; and wherein the lower visor is configured to enable relative movement between the plurality of tab assemblies and the pairs of rails in the plurality of elongated slots to slidably adjust in a second direction relative to the shell, thereby retracting the lower visor to align with the upper visor in a retracted position.

9. The adjustable visor apparatus of claim 8, wherein each tab assembly in the plurality of tab assemblies comprises a plate disposed on the pair of rails of one of the plurality of elongated slots in the upper visor and a post coupled to the plate and lower visor, the post oriented generally upright and extending through spacing between the pair of rails.

10. The adjustable visor apparatus of claim 9, wherein each tab assembly in the plurality of tab assemblies comprises a stop protrusion coupled to the post, the stop protrusion configured to contact the second end face another side wall of the elongated slot in one of the plurality of elongated slots when the lower visor is in the retracted position.

11. The adjustable visor apparatus of claim 9, wherein the lower visor comprises a plurality of pairs of slits disposed therethrough, each pair of slits in the plurality of pairs of slits extending along opposite sides of the post of one of the tab assemblies in the plurality of tab assemblies.

12. The adjustable visor apparatus of claim 8, further comprising a grip member coupled to a bottom surface of the lower visor.

13. The adjustable visor apparatus of claim 8, wherein each slot has a slot width between opposing side walls of the slot, wherein each pair of rails forms a rail-slot width between the rails along their lengths, wherein the rail-slot width is shorter than the slot width, and wherein the opening is wider than the rail-slot width between the pair of rails.

14. The adjustable visor apparatus of claim 8, wherein the upper visor has an upper visor upper surface and an upper visor lower surface, and wherein the pair of opposing side walls is situated between the upper visor upper surface and the upper visor lower surface.

15. A hat worn on a head of a user with an adjustable visor, the hat comprising:

a shell configured to be disposed on the head of the user, wherein the shell has a front shell surface;

an upper visor coupled to the shell, projecting from the front shell surface at an angle that is substantially transverse to the front shell surface and comprising a plurality of elongated slots formed through the upper visor, each elongated slot having a first end face, a second end face and a pair of opposing side walls connecting the first and second end faces together, each elongated slot having a slot length extending between the first and second end faces, each elongated slot in the plurality of elongated slots comprising a pair of rails connected to the upper visor, each pair of rails having a distance between them and each pair of rails having a rail length that is shorter than the slot length such that the pair of rails partly extends along the elongated slot to create an opening between the side walls and between the rails and the second end face of the elongated slot proximate the shell such that the opening is wider than the distance between the pair of rails in the elongated slot; and a lower visor slidably mounted to the upper visor and comprising a plurality of tab assemblies, each tab assembly in the plurality of tab assemblies slidably mounted to the pair of rails of one of the plurality of elongated slots in the upper visor;

wherein the lower visor is configured to slidably adjust in a first direction relative to the shell to enable the plurality of tab assemblies of the lower visor to traverse the pairs of rails in the plurality of elongated slots of the upper visor, thereby extending the lower visor beyond the upper visor in an extended position at the angle that is substantially transverse to the front shell surface; and wherein the lower visor is configured to slidably adjust in a second direction relative to the shell to enable the plurality of tab assemblies of the lower visor to traverse the pairs of rails in the plurality of elongated slots of the upper visor, thereby retracting the lower visor to align with the upper visor in a retracted position.

16. The hat of claim 15, wherein each tab assembly in the plurality of tab assemblies comprises a plate disposed on the pair of rails of one of the plurality of elongated slots in the upper visor and a post coupled to the plate and lower visor, the post oriented generally upright and extending through spacing between the pair of rails.

17. The hat of claim 16, wherein each tab assembly in the plurality of tab assemblies comprises a stop protrusion coupled to the post, the stop protrusion configured to contact the second end face of the elongated slot in one of the plurality of elongated slots when the lower visor is in the retracted position.

18. The hat of claim 16, wherein the lower visor comprises a plurality of pairs of slits disposed therethrough, each pair of slits in the plurality of pairs of slits extending along opposite sides of the post of one of the tab assemblies in the plurality of tab assemblies.

19. The hat of claim 15, further comprising a grip member coupled to a bottom surface of the lower visor.

20. The hat of claim 15, wherein each slot has a slot width between opposing side walls of the slot, wherein each pair of rails forms a rail-slot width between the rails along their lengths, wherein the rail-slot width is shorter than the slot width, and wherein the opening is wider than the rail-slot width between the pair of rails.

21. The hat of claim 15, wherein the upper visor has an upper visor upper surface and an upper visor lower surface, and wherein the pair of opposing side walls is situated between the upper visor upper surface and the upper visor lower surface.

22. The hat of claim 1, wherein the upper visor has an upper visor proximal edge that is in proximity to the shell, wherein the upper visor has an upper visor distal edge that is farther from the shell than is the upper visor proximal edge, wherein the lower visor has a lower visor proximal edge that is in proximity to the shell when the lower visor is in a retracted position, wherein the lower visor has a lower visor distal edge that is farther from the shell than is the lower visor proximal edge, and wherein the lower visor distal edge and the upper visor distal edge are aligned when the lower visor is in the retracted position.

23. The adjustable visor apparatus of claim 8, wherein the upper visor has an upper visor proximal edge that is in proximity to the shell, wherein the upper visor has an upper visor distal edge that is farther from the shell than is the upper visor proximal edge, wherein the lower visor has a lower visor proximal edge that is in proximity to the shell when the lower visor is in a retracted position, wherein the lower visor has a lower visor distal edge that is farther from the shell than is the lower visor proximal edge, and wherein the lower visor distal edge and the upper visor distal edge are aligned when the lower visor is in the retracted position.

24. The hat of claim 15, wherein the upper visor has an upper visor proximal edge that is in proximity to the shell, wherein the upper visor has an upper visor distal edge that is farther from the shell than is the upper visor proximal edge, wherein the lower visor has a lower visor proximal edge that is in proximity to the shell when the lower visor is in a retracted position, wherein the lower visor has a lower visor distal edge that is farther from the shell than is the lower visor proximal edge, and wherein the lower visor distal edge and the upper visor distal edge are aligned when the lower visor is in the retracted position.

* * * * *